United States Patent [19]

Waid

[11] Patent Number: 5,058,707

[45] Date of Patent: Oct. 22, 1991

[54] WORK SHELF FOR A FOLDING STEPLADDER

[76] Inventor: Calvin R. Waid, 1619 Bradford Ave., Shillington, Pa. 19607

[21] Appl. No.: 612,450

[22] Filed: Nov. 14, 1990

[51] Int. Cl.[5] ..... E06C 7/14

[52] U.S. Cl. ..... 182/120; 182/126; 248/238

[58] Field of Search ..... 182/120, 126, 124; 248/238

[56] References Cited

U.S. PATENT DOCUMENTS

| | | | |
|---|---|---|---|
| 570,661 | 11/1896 | Cantrell | 182/120 |
| 2,066,108 | 12/1936 | Hedges | 182/120 |
| 2,308,180 | 1/1943 | Larsen | 248/238 |
| 3,106,987 | 10/1963 | Lerner | 182/126 |
| 3,111,193 | 11/1963 | McKinnie | 182/120 |
| 3,812,932 | 5/1974 | Davis | 182/126 |
| 4,460,063 | 7/1984 | Casada | 248/238 |

*Primary Examiner*—Reinaldo P. Machado

*Attorney, Agent, or Firm*—Antonelli, Terry, Stout & Kraus

[57] ABSTRACT

A work shelf for removable installation and use on a stepladder to provide an enlarged, sturdy area for holding tools and material. The work shelf includes a platform area of a width greater than the distance between the ladder rear legs, a neck extending from one edge of the platform area and having a width less than the distance between the ladder rear legs, and a brace extending from the neck and having a width less than the distance between the ladder front legs. A retaining edge extends up from the platform area. In use, the platform area overlies and is supported on the stepladder shelf, while the neck extends between the ladder rear legs, and the brace is positioned between the ladder front legs and beneath one of the ladder steps. A clamp is movably fastened to the neck. With the work shelf in position on a stepladder the clamp is secured in a position abutting the ladder rear legs. In this position, the clamp cooperates with the rear legs, while the brace cooperates with the adjacent shelf to securely hold the work shelf on the ladder.

6 Claims, 1 Drawing Sheet

WORK SHELF FOR A FOLDING STEPLADDER

BACKGROUND OF THE INVENTION

The present invention pertains to a work shelf for holding tools and work materials on a ladder. More particularly, the present invention pertains to an improved work shelf which can be removably fastened on a stepladder, to hold tools and other work materials for someone working on the ladder, while inhibiting the materials from falling from the work shelf.

Ladders are used for many tasks, including enabling someone to work on an elevated object. During such work, the person performing the work often requires the availability of various tools such as hammers, screwdrivers, pliers, etc. Ladders are also frequently utilized to enable a person to paint an area such as the higher portions of a wall or such as a ceiling. If, for example, the paint is being applied with a roller, then a sloped pan might be desired adjacent the top of the ladder to hold the supply of paint. Alternatively, if a brush is being used to supply the paint, then either a can or bucket of paint or a pan filled with paint might be desired adjacent the top of the ladder.

The typical stepladder has two front legs which support the step members and two rear legs which leaningly support the front legs and thus the step members. The front legs are typically rigidly fastened to a top step, while the rear legs are pivotally attached to that same top step. This permits the stepladder to be folded for storage. Such stepladders generally have a small, pivotally attached ladder shelf which, when the ladder is in use, extends horizontally from the rear legs, generally at a height at or just below the first step down from the top of the ladder. The ladder shelf can be pivoted to lie flat against the rear legs when the ladder is folded for storage. The pivotal attachment often results in the shelf being somewhat unstable. In addition, such shelves are generally small, with only limited surface area for holding tools. Often, also, such shelves consist of two boards fastened to cross-arms and having a gap between them. Further, such a shelf is generally made of light materials and can support only moderate weight. As a result of all this, tools or other items are likely to drop from the shelf, making it necessary for the person on the ladder to get down to retrieve the dropped items.

SUMMARY OF THE INVENTION

The present invention is an improved work shelf for use with a ladder such as a stepladder. In accordance with the present invention, a work shelf for use with a ladder includes a platform member providing a large work area and encircled by an upwardly extending side edge to inhibit objects from falling off the side of the shelf. A neck member extends from the platform member and is positioned between the ladder rear legs during use of the shelf on a stepladder. A brace member extends from the neck portion and, during use on a stepladder, is positioned beneath a step of the ladder to bear upwardly against that step. A clamp member is affixed to the top of the neck member and cooperates with the ladder rear legs while the brace member cooperates with the adjacent step of the ladder to securely retain the work shelf on the ladder. The clamp member also cooperates with the side edge and the ladder rear legs to provide an edge encircling the periphery of the platform member, inhibiting tools and materials from falling off the work shelf. Nevertheless, the clamp member can be readily moved, or removed, to permit removal of the work shelf from the ladder for storage.

BRIEF DESCRIPTION OF THE DRAWINGS

These and other aspects and advantages of the present invention are more apparent in the following detailed description of a preferred embodiment and claims, particularly when considered with the accompanying drawings in which like parts bear like reference numerals. In the drawings:

DETAILED DESCRIPTION OF A PREFERRED EMBODIMENT

Figure 1:
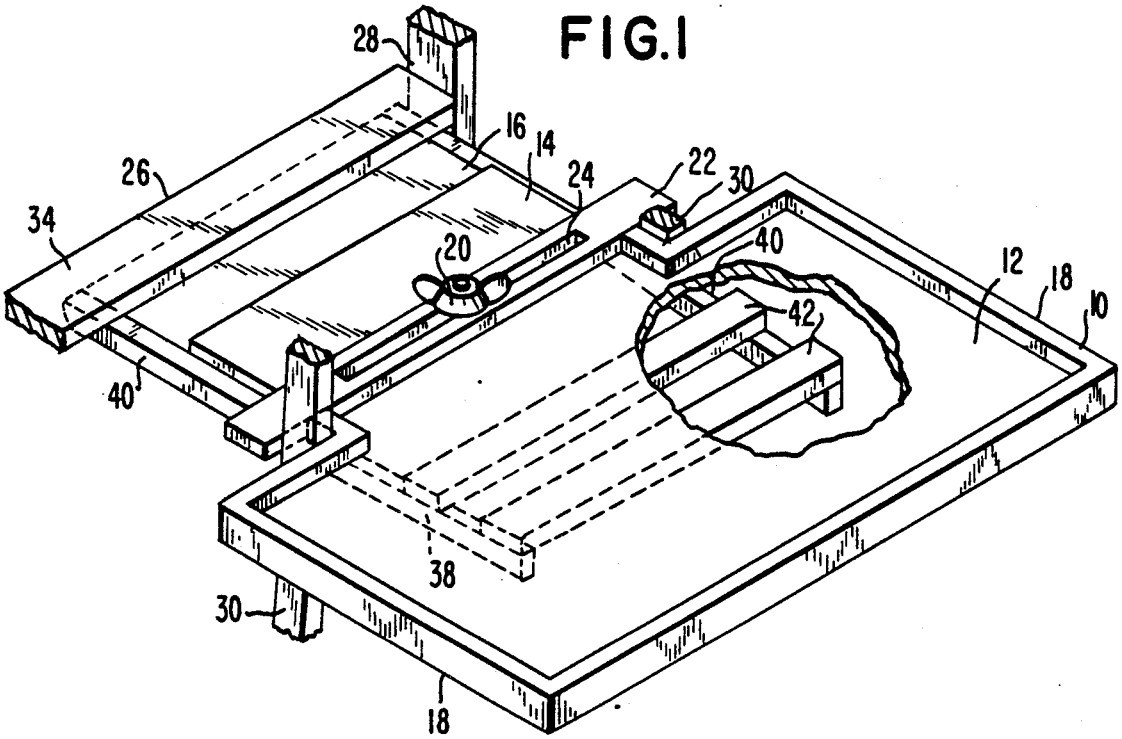
FIG. 1 is a fragmentary rear perspective view showing a work shelf in accordance with a preferred embodiment of the present invention removably attached on a stepladder.
Figure 2:
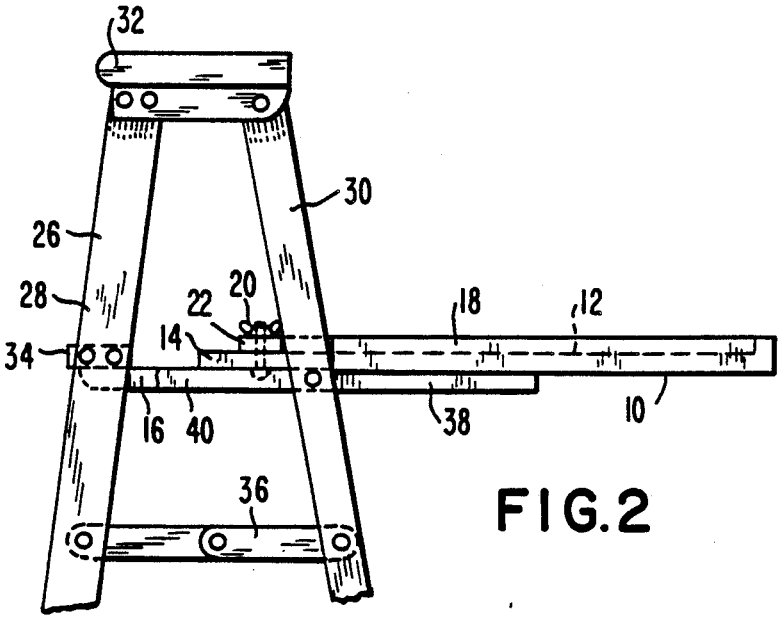
FIG. 2 is a fragmentary side perspective view of the work shelf of FIG. 1 on a stepladder.

FIGS. 1 and 2 depict a work shelf 10 in accordance with the present invention mounted on a ladder 26. Ladder 26 is depicted as a conventional stepladder and includes a pair of front legs 28 and a pair of rear legs 30. Front legs 28 are fixedly attached to top step 32 of the ladder, while rear legs 30 are pivotably attached to top step 32. A plurality of step members 34 are fixedly attached between the front legs 28 at regularly-spaced intervals beneath top step 32. A hinge member 36 joins the right front and rear legs, and another hinge member joins the left front and rear legs. Ladder 26 is provided with a ladder shelf 38, made up of two shelf arms 40 and two cross members 42. Each shelf arm 40 is pivotably connected to an associated rear leg 30, and the two shelf arms 40 extend beneath a step member 34, for example the uppermost step member 34. Each cross member 42 extends across and is connected to the two shelf arms 40. As depicted in FIG. 1, a gap generally exists between the two cross members 42. Further, the limited size of the cross members 42 provides only a small area to hold tools and materials. Ladder shelf 38 can pivot between the work position depicted in FIGS. 1 and 2 and a storage position in which support members 42 are adjacent rear legs 30. With ladder shelf 38 in this storage position, rear legs 30 can be pivoted to a position adjacent front legs 28 to permit storage of the ladder Work shelf 10 includes a platform member 12, a neck member 14, and a brace member 16. Platform member 12, by way of example, might have a width in the order of about 19 inches and a length in the order of about 15 inches. Neck member 14 extends from one end of platform member 12 a distance in the order of about 6½ inches, with a width in the order of about 9½ inches. Brace member 16 extends from neck member 14 in the direction opposite platform member 12 a distance in the order of about 4 inches, with a width in the order of about 9½ inches. An upwardly extending side edge 18 extends around the periphery of platform member 12 and for a short distance along each side of neck member 14. Platform member 12, neck member 14 and brace member 16 each might have a thickness in the order of about one-half inch. Preferably, platform member 12 and neck member 14 are formed from a single piece of material, for example a piece of one-half inch plywood, while brace member 16 is formed of a second piece of material, again for example a piece of one-half inch plywood, and is fastened to the lower surface of neck member 12, for example by means of nails, screws, bolts, glue, or a combination of such fastening means. As a consequence, platform member 12 and neck member 14 are coplanar, while brace member 16 is offset from platform member 12 and neck member 14.

A clamp member 22 is pivotably fastened to the upper surface of neck member 14, for example by a bolt and wing nut combination 20. Clamp member 22 might have a length in the order of about 15 inches, a width in the order of about 2 inches, and a thickness in the order of about ½ inch. An elongated slot 24, having a length in the order of about 9 inches and a width in the order of about 3/16 inch passes through clamp member 22, permitting the bolt of combination 20 to pass through clamp member 22 and through a hole (not shown) in neck member 14. Slot 24 allows the position of clamp member 26 to be adjusted on neck member 14 when bolt and wing nut combination 20 is loosened. When clamp member 26 is in a desired position, bolt and wing nut combination 20 can be tightened to retain clamp member 22 in that position.

Work shelf 10 is mounted on stepladder 26 with platform member 12 overlying and supported on ladder shelf 38. Neck member 14 extends between the rear legs 30 of ladder 26 and might overlie shelf arms 40. Brace member 16 lies between shelf arms 40 and extends between the front legs 28 of ladder 2 and beneath one of the step members 34, depending on the height of the ladder shelf 38, for example beneath the uppermost step member of 34 below top step 32, and bears upwardly against that step member. With work shelf 10 in this position, clamp member 22 is adjusted so that its two ends overlie the two pivotal arms 40 of the ladder's work shelf 38 and abut the two rear legs 30 of ladder 26, as depicted in FIG. 2. Bolt and nut combination 20 is then tightened to retain clamp member 22 in this position, and clamp member 22 cooperates with rear legs 30 while brace member 16 cooperates with the adjacent step member 34 to securely retain work shelf 10 on ladder 26. In this position, clamp member 22 also cooperates with side edge 18 and rear legs 30 to provide an edge fully encircling platform member 12 of work shelf 10, reducing the likelihood of tools or material falling off the work shelf. In addition, work shelf 10 provides a larger area for holding tools and materials than does ladder shelf 38. Further, the sturdy materials from which work shelf 10 is made and the secure attachment of the work shelf on ladder 26 enable work shelf 10 to support greater weight of tools and materials than can ladder shelf 38. While a platform member 12 has been depicted in the order of 19 inches by 15 inches, any size can be provided for the particular ladder and the particular application.

To install or remove work shelf 10, bolt and wing nut combination 20 is loosened, and clamp member 22 is slid to a position free from the rear legs 30 of ladder 26, such as depicted in FIG. 1. Work shelf 10 can then be installed or removed by passing brace member 16 and neck member 14 between the legs 28, 30 of ladder 10. When the work shelf is positioned on ladder 26 with platform member 12 abutting the rear sides of the two rear legs 30, clamp member 22 is positioned to abut the front sides of the two rear legs 30, as depicted in FIG. 2, and bolt and nut combinaton 20 is tightened to securely retain the work shelf 10 on the ladder. Thus, work shelf 10 can be easily installed and removed. While FIG. 1 depicts clamp member 22 with an elongated slot 24 permitting movement of clamp member 22 on neck member 14 while maintaining the clamp member and neck member connected to each other to thereby reduce the likelihood of misplacing clamp member 22 or bolt and wing nut combination 20, a circular hole can pass through clamp member 22 instead, with bolt and wing nut combination 20 being removed to permit movement of clamp member 22 for removal and installation of work shelf 10 on the ladder.

The present invention thus provides a large area for holding tools and materials, and the upwardly extending side edge 18, together with clamp member 22, inhibit the tools and materials from falling from the work shelf. Further, the cooperation of clamp member 22 and brace 16 with rear legs 30 and with one of the step members 34 securely holds work shelf 10 on the ladder and permits support of increased weight of tools and materials.

Although the present invention has been described with reference to a preferred embodiment, numerous modifications and rearrangements can be made, and still the result would be within the scope of the invention.

What is claimed is:

1. A work shelf for removable installation and use on a, stepladder having a pair of front legs, a pair of rear legs, a plurality of steps supported by the front legs, and a ladder shelf extending from the rear legs, said work shelf comprising:

a substantially rectangular platform member having a width greater than the spacing between the ladder rear legs;

a neck member extending from said platform member and having a width less than the spacing between the ladder rear legs;

a brace member extending from said neck member in the direction opposite said platform member and having a width less than the spacing between the ladder front legs;

clamp means movably secured to said neck member for movement between a clamping position, in which, when said platform member overlies the ladder shelf, and said neck member and said bracing member extend between the ladder legs with said bracing member braced beneath a step of the ladder, said clamp means cooperates with legs of the ladder to securely retain the work shelf on the ladder, and a release position, in which the clamp means is free of the ladder legs, permitting the work shelf to be installed on and removed from the ladder.

2. A work shelf as claimed in claim 1, further comprising a retaining edge member extending from the periphery of said platform member in a direction substantially perpendicular to the surface of said platform member to inhibit objects on the platform member from falling off said work shelf.

3. A work shelf as claimed in claim 2, wherein said clamp means in the clamping position cooperates with the ladder rear legs and the retaining edge member to encircle the periphery of the platform member.

4. A work shelf as claimed in claim 1, wherein said platform member and said neck member are substantially coplanar and said brace member extends from one planar surface of said neck member to be offset therefrom.

5. A work shelf as claimed in claim 1, wherein said clamp member comprises an elongated member having an opening therethrough, and a bolt and wing nut combination, and in the clamping position the bolt of said combination passes through the elongated member opening and through an opening in said neck member and the wing nut of said combination is tightened on said bolt to retain the elongated member in the clamping position.

6. A work shelf as claimed in claim 5, wherein the elongated member opening is an elongated slot.

* * * * *